US005812040A

United States Patent [19]

Moeller

[11] Patent Number: 5,812,040

[45] Date of Patent: Sep. 22, 1998

[54] MICROWAVE VACUUM WINDOW HAVING WIDE BANDWIDTH

[75] Inventor: Charles Porter Moeller, Del Mar, Calif.

[73] Assignee: General Atomics, San Diego, Calif.

[21] Appl. No.: 809,288

[22] PCT Filed: Jul. 17, 1996

[86] PCT No.: PCT/US96/11758

§ 371 Date: Mar. 14, 1997

§ 102(e) Date: Mar. 14, 1997

[87] PCT Pub. No.: WO97/04495

PCT Pub. Date: Feb. 6, 1997

Related U.S. Application Data

[60] Provisional application No. 60/001,208, Jul. 18, 1995.

[51] Int. Cl.[6] ..... H01P 1/08

[52] U.S. Cl. ..... 333/252; 333/35

[58] Field of Search ..... 333/35, 252

[56] References Cited

U.S. PATENT DOCUMENTS

| | | | |
|---|---|---|---|
| 5,051,715 | 9/1991 | Agosti et al. | 333/252 |
| 5,313,179 | 5/1994 | Moeller | 333/252 |
| 5,400,004 | 3/1995 | Moeller | 333/252 |
| 5,548,257 | 8/1996 | Caplan et al. | 333/252 |

FOREIGN PATENT DOCUMENTS 0 031 275 A1 7/1981 European Pat. Off. .

OTHER PUBLICATIONS

International Search Report dated Oct. 25, 1996 for International Application PCT/US96/11758.

1986 IEEE–MTT–S International Microwave Symposium—Digest, Jun. 2–4, 1986, Baltimore, USA, pp. 151–154, deRonde: "An octave–wide matched impedance step and—quarterwave transformer".

*Primary Examiner*—Paul Gensler

*Attorney, Agent, or Firm*—Fitch, Even, Tabin & Flannery

[57] ABSTRACT

A distributed microwave window (12) couples microwave power in the HE11 mode between a first large diameter waveguide (32) and a second large diameter waveguide (34), while providing a physical barrier between the two waveguides, without the need for any transitions to other shapes or diameters. The window comprises a stack of alternating dielectric (14) and hollow metallic (16) strips, brazed together to form a vacuum barrier. The vacuum barrier is either transverse to or tilted with respect to the waveguide axis. The strips are oriented to be perpendicular to the transverse electric field of the incident microwave power. The metallic strips are tapered on both sides of the vacuum barrier, which taper serves to funnel the incident microwave power through the dielectric strips (14). A suitable coolant flows through a coolant channel (18) that passes through the metallic strips (16). The microwave window further includes an impedance matching transition (15) between the tapered metal vanes and insulating dielectric material used to create the vacuum barrier of the window. Such impedance matching transition comprises one or more quarter wave ($\lambda/4$) matching sections in the individual vane structure that achieves the required impedance match. The effect of such impedance match is to render the dielectric material, e.g., sapphire, non resonant. Such non-resonance significantly widens the bandwidth of the window.

10 Claims, 10 Drawing Sheets

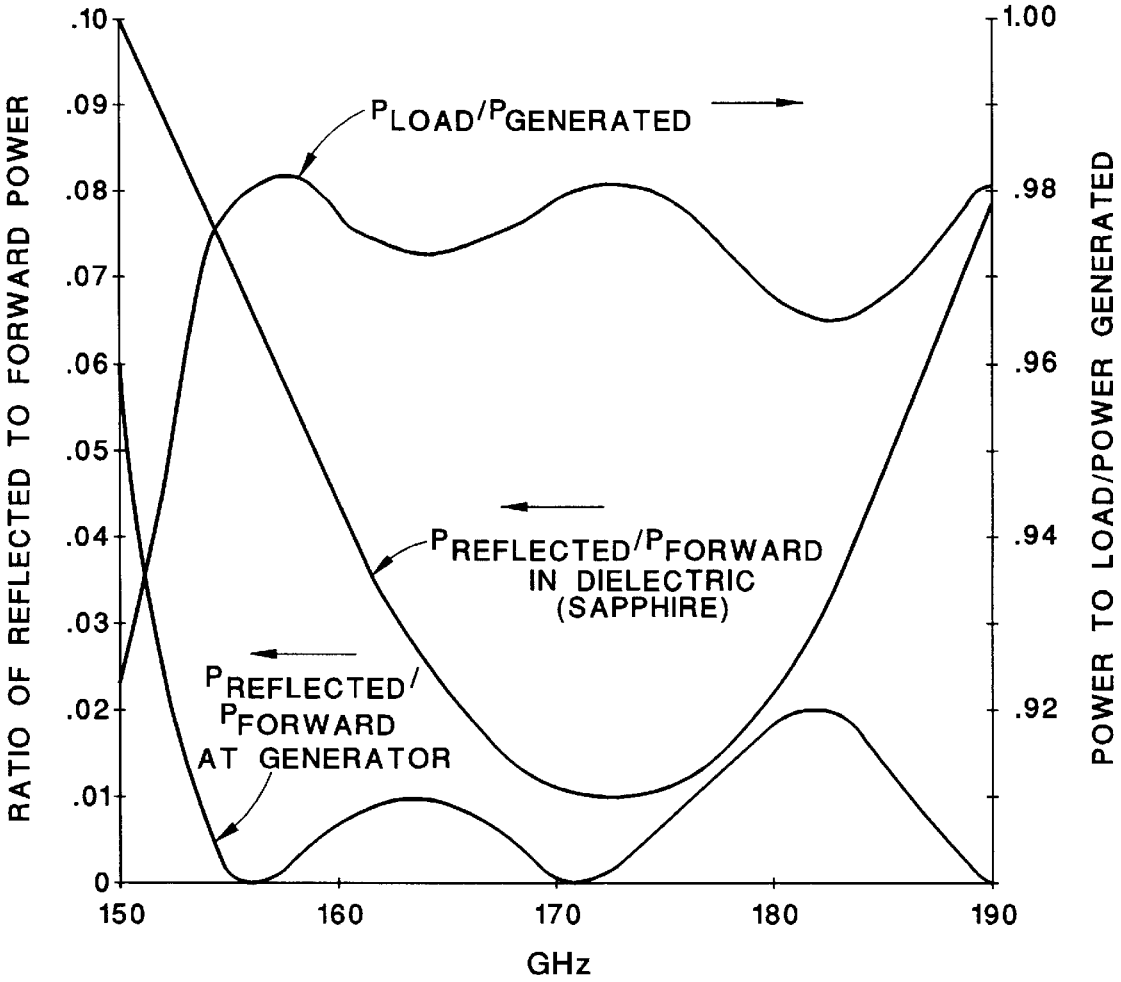
FIG. 18
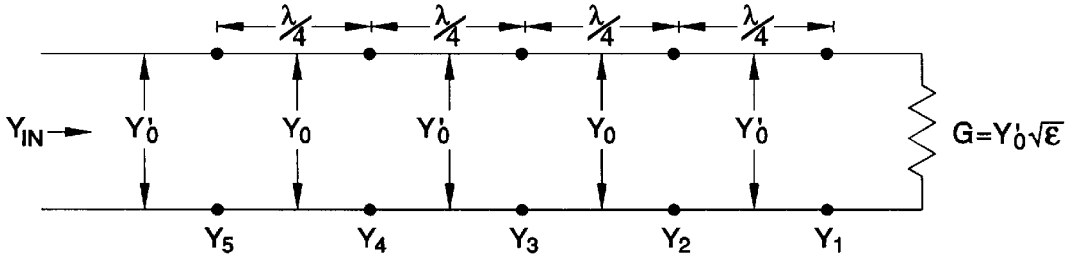
FIG. 20 $Y_0$, $Y'_0$ CHARACTERISTIC ADMITTANCE OF TRANSMISION LINE. $Y_1 \ldots Y_5$-ADMITTANCE ACROSS TERMINALS

MICROWAVE VACUUM WINDOW HAVING WIDE BANDWIDTH

This application claims the benefit of U.S. Provisional application Ser. No. 60/001,208, filed Jul. 18, 1995.

BACKGROUND OF THE INVENTION

The present invention relates to large diameter microwave waveguides, and more particularly to a distributed window that may be used in such waveguides to couple high frequency, high power microwave radiation through a vacuum barrier within the waveguide without overheating, significant mode conversion, or reflection of incident power. Even more particularly, the invention relates to the use of an impedance transition built into the vanes of the vacuum barrier to increase the bandwidth of the window. Such impedance transition, which comprises one or more quarter wave matching sections in the individual vane structure, makes the dielectric material used as part of the vane structure non resonant. In turn, this non resonant condition reduces the power dissipated in the dielectric, and thereby increases the power handling ability of the window.

A waveguide window in a microwave power system permits power to be coupled from a first waveguide to a second waveguide, but presents a physical barrier between the two waveguides. The physical barrier allows the waveguides to contain different gases or to be at different pressures, and one or both waveguides may be evacuated. For example, in high power microwave vacuum devices, such as gyrotrons and the like, the output power must be coupled between an evacuated chamber or waveguide in the gyrotron device, through one or more waveguide windows, into a waveguide having a gaseous environment. The one or more waveguide windows thus provide a hermetic seal between the two media. Also, in fusion reactors where microwave power is added to a plasma, the physical barrier of a microwave window may be placed near the reactor to confine the constituents of the plasma.

One type of microwave window known in the art is a double-disk window. A double-disk window can be tuned over a limited frequency range to compensate for errors in window thickness or unit-to-unit variation in gyrotron output frequency.

Another type of microwave window known in the art is described in U.S. Pat. No. 5,061,912, incorporated herein by reference. The type of microwave window disclosed in the '912 patent is a distributed window that forms part of a phase velocity coupler. The type of coupling provided by the described window is between two identical corrugated rectangular waveguides, each of which is many (e.g., >15) free space wavelengths, $\lambda_0$, wide in one transverse dimension but only 2 to 3 $\lambda_0$ in the other dimension. A transition from circular corrugated waveguide many $\lambda_0$ in diameter propagating the $HE_{11}$ mode, which is a preferred method of low loss transmission for high power millimeter wavelength microwaves, to this rectangular corrugated waveguide, can always be made. However, if the circular waveguide is very large, e.g., $30\lambda_0$in diameter, many modes which can propagate in the larger circular waveguide are cut off in the rectangular waveguide. Although ideally, only one mode is emitted from the source, typically a gyrotron, and propagated through the system, in reality there is often a few percent of other modes present, which might be reflected back to the source with deleterious effects by such a transition. Hence, there is a need in the art for a microwave window that can be used to directly and efficiently couple high frequency microwave power between two large diameter waveguides without the need for any transitions to other shapes and sizes.

Such needs are met, at least in part, by the large diameter distributed microwave windows disclosed in applicant's prior U.S. Pat. No. 5,313,179 and 5,400,004. Advantageously, such large diameter microwave windows are particularly well-suited for use with the new generation of gyrotrons, such as the Russian 500 kw, 110 and 140 GHz gyrotrons which have the $HE_{11}$ output mode, which are most compatible with a large output diameter. Unfortunately, however, depending upon the type of dielectric material that is used in the vane structure of such windows, the bandwidth of such distributed windows may be very narrow. For example, when sapphire is used as the dielectric, the high dielectric constant of sapphire renders the bandwidth of the window very narrow. Such narrow bandwidth may cause problems with the gyrotron operation, and could make the distributed window less attractive than the double-disk window. Hence, there is a need in the art for a way to widen the bandwidth of the distributed microwave window.

SUMMARY OF THE INVENTION

The present invention addresses the above and other needs by providing a distributed microwave window similar in construction to the windows described in the above-referenced '179 and '004 patents, but which further includes an impedance matching transition between the tapered metal vanes and insulating dielectric material used to create the vacuum barrier of the window. Such impedance matching transition comprises one or more quarter wave matching sections in the individual vane structure that achieves the required impedance match. The effect of such impedance match is to render the dielectric material, e.g., sapphire, non resonant. Such non-resonance significantly widens the bandwidth of the window.

In accordance with one aspect of the invention, once the required impedance match is achieved, a significant reduction in the power dissipated in the dielectric material also results. If the dielectric material is sapphire, for example, the reduction in power dissipated in the sapphire is almost 50%. Such reduction in power dissipation means that the power handling ability of the window is greatly increased.

As described in the referenced '170 and/or '004 patents, the basic distributed microwave window of the present invention includes a barrier formed from a stack of alternating dielectric and hollow metallic strips, brazed together to make good thermal contact with each other and to form a vacuum seal. The hollow metallic strips are positioned to be perpendicular to the transverse electric field of the incident wave. The metallic strips further include a specified taper that deflects the incident microwave power away from the metallic strips and through the dielectric strips. A coolant is pumped through the hollow metallic strips in order to remove heat generated at the dielectric strips by the microwave power passing therethrough.

The impedance matching transition in accordance with the present invention includes one or more quarter wave matching sections that interface the tapered metallic strips with the dielectric strips.

BRIEF DESCRIPTION OF THE DRAWINGS

The above and other aspects, features and advantages of the present invention will be more apparent from the following more particular description thereof, presented in conjunction with the following drawings wherein:

FIG. 18 is a graph that illustrates the ratio of reflected to forward power, and the ratio of power delivered to the load and power generated as a function of frequency for the waveguide window structure of FIG. 13A;

FIG. 20 is the equivalent transmission line circuit for the waveguide structure shown in FIG. 19.

Corresponding reference characters indicate corresponding components throughout the several views of the drawings.

DETAILED DESCRIPTION OF THE INVENTION

Figure 1:
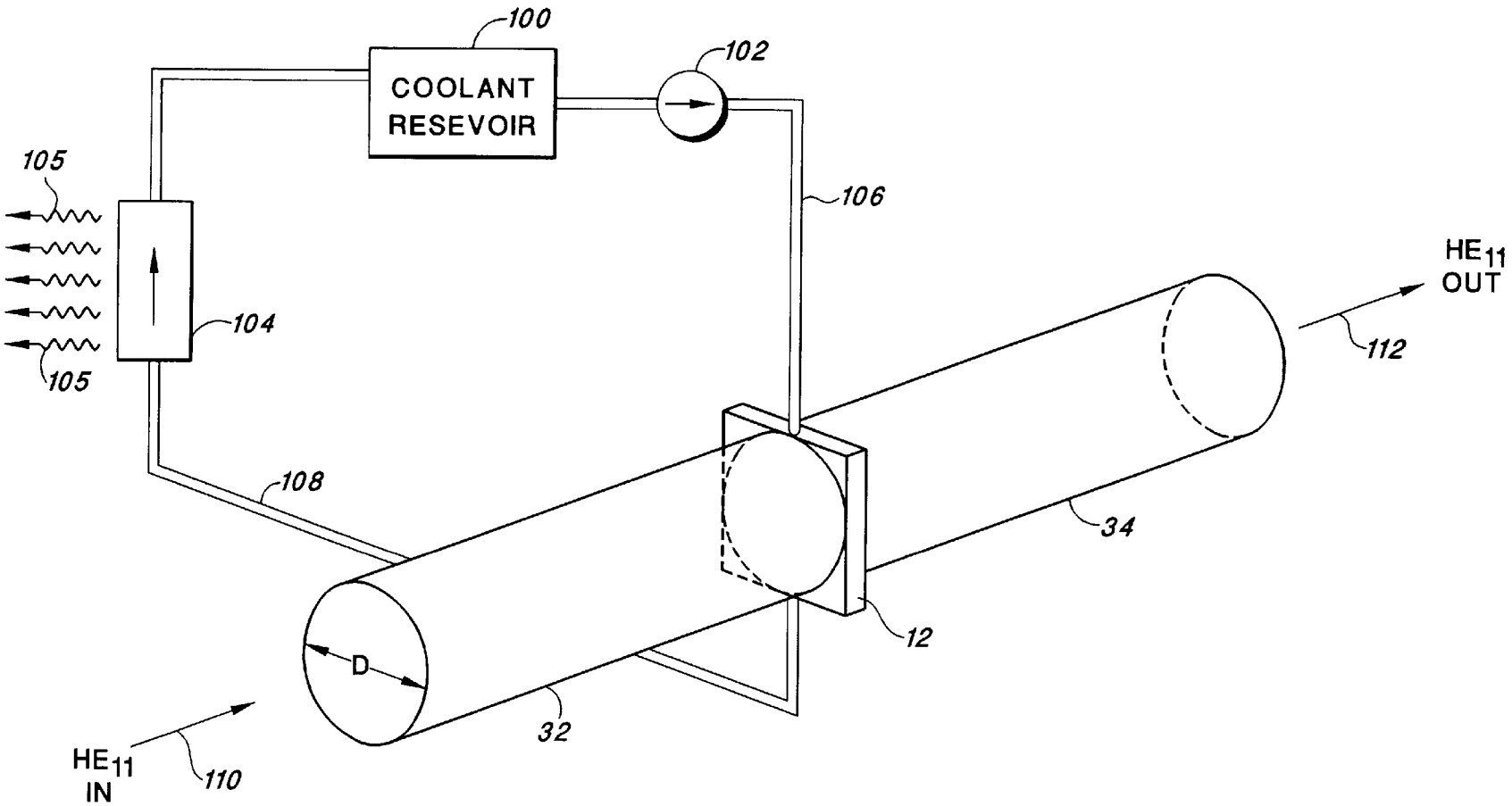
FIG. 1 (PRIOR ART)
FIG. 1 shows a distributed window made in accordance with the present invention that couples two large diameter waveguides.

The following description is of the best mode presently contemplated for carrying out the invention. This description is not to be taken in a limiting sense, but is made merely for the purpose of describing the general principles of the invention.

FIGS. 1–9 are described in applicant's prior U.S. Pat. No. 5,400,004, incorporated herein by reference. It is noted that the '004 patent is a continuation-in-part of applicant's prior U.S. Pat. No. 5,313,179, and that the entire substantive disclosure of the '179 patent is included in the '004 patent.

FIGS. 1–9 describe a distributed microwave window that is suitable for some applications, e.g., as described in the previously referenced '179 or '004 patents. However, it has recently been discovered that the bandwidth of the distributed window as disclosed in the '179 or '004 patents (hereafter the "179/004 window") is really rather narrow. Although its bandwidth is accurately represented by that of a simple single disk sapphire window of the same thickness as that used in the 179/004 window, it turns out that such bandwidth is rather narrow for some applications. It had been supposed that the bandwidth of the 179/004 window would be better than the bandwidth of, e.g., Varian's double disk window. In one sense, the bandwidth of the 179/004 window may be better than that of the Varian window. However, the Varian window can be tuned by varying the spacing between disks, whereas the 179/004window cannot be tuned. Hence, there is the probability that the operation of a gryroton could be adversely influenced by using the 179/004 window. In particular, a reflection from a 179/400 window could raise the cavity "Q", thereby increasing cavity dissipation, or reducing efficiency.

A method is described in the '004 patent for transverse grooving of the edge of the sapphire (dielectric), where the grooves were to act as a matching section of intermediate dielectric constant. To date, this scheme has never been implemented to applicant's knowledge because the required grooves, which must be spaced less than ½ wavelength in the dielectric, appear to be too fine to make economically. Making fine groves of this type is particularly problematic since the strength of sapphire depends critically on surface finish, which is difficult to control in the grooves. There also appears to be some uncertainty regarding the power dissipation in the grooved sapphire section.

In a plane disk window, the use of a ¼ wavelength ($\lambda/4$) matching layer on each surface, either by grooving or by application of a layer of a different (intermediate) dielectric constant, is the only known way to make the window broadband.

In the case of the distributed window (i.e., the 179/004 window), however, in which the power is divided among many narrow slot windows, the spacing of which is less than one free space wavelength, it is possible to utilize the metal structure supporting the strips as a matching section, since only one transverse mode is supported in the slots in which the dielectric strip windows are located.

The result of having such matching sections is to widen the bandwidth of the window, and thereby reduce the dissipation in the dielectric vacuum barrier. Both effects are due to the absence of a standing wave in the dielectric by the use of matching sections. A standing wave does exist in the matching sections, but because they are much shorter and contain no dielectric, the bandwidth is greatly increased and lossess reduced.

Figure 2A:
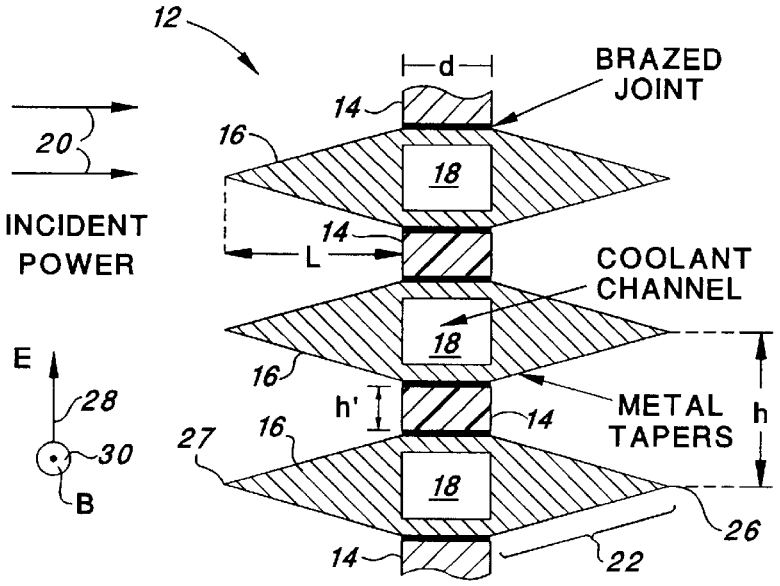
FIG. 2A (PRIOR ART)
FIG. 2A shows a typical cross-sectional view of a portion of a barrier used to form the microwave window in accordance with the invention disclosed in the '179 and '004 patents.
Figure 2B:
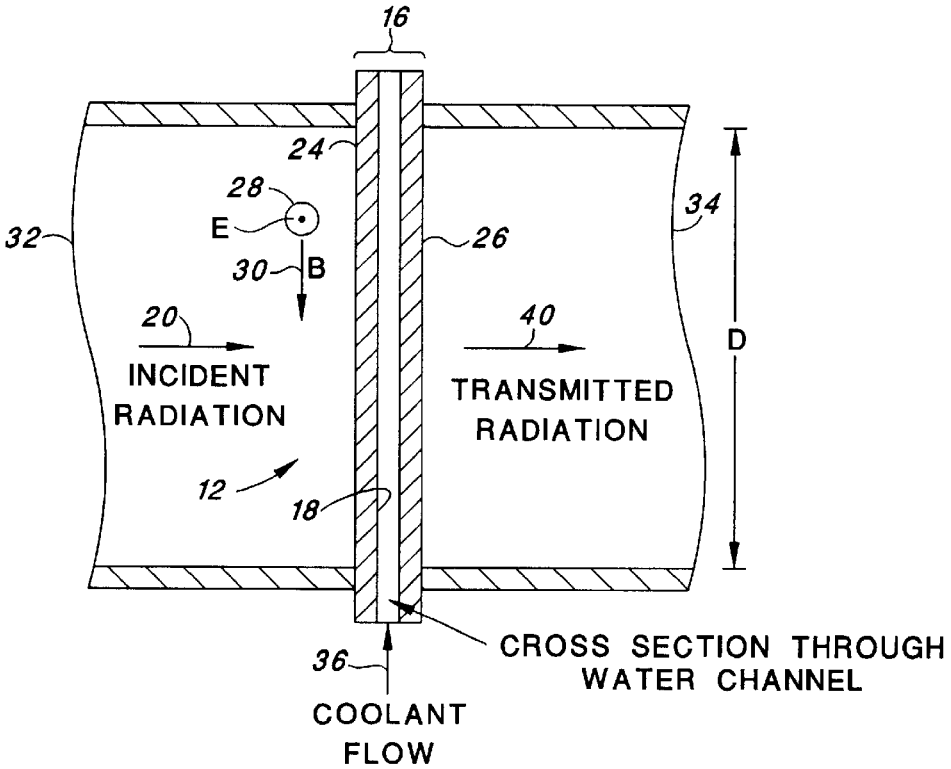
FIG. 2B (PRIOR ART)
FIG. 2B illustrates a cross-sectional view through one of the coolant channels of a metallic strip used within the microwave window of FIG. 2A.
Figure 3:
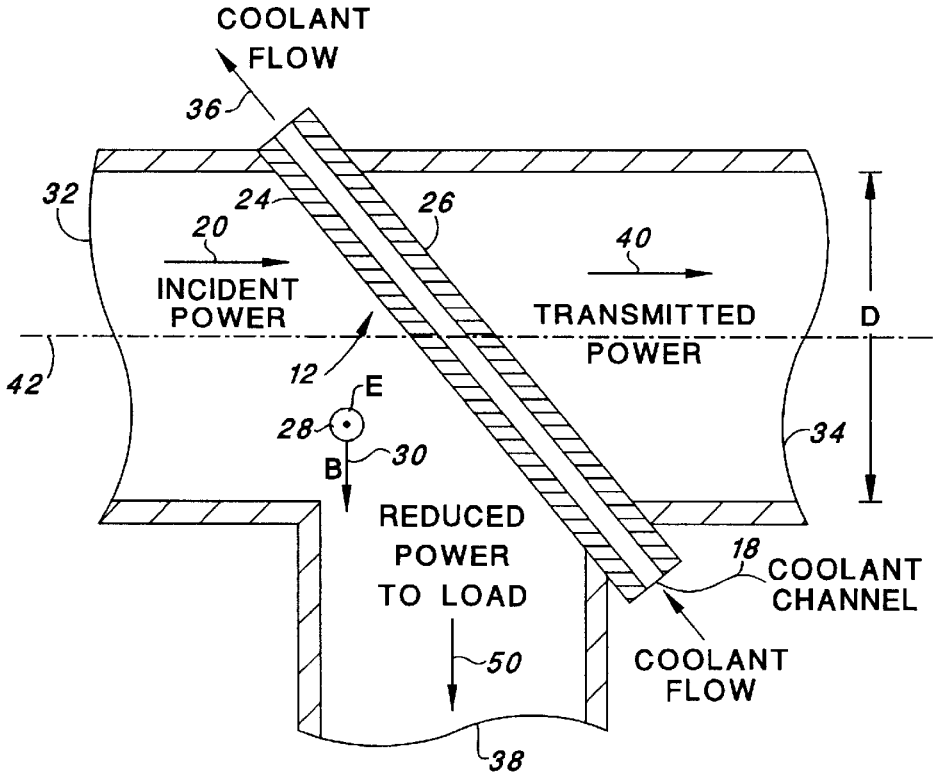
FIG. 3 (PRIOR ART)
FIG. 3 depicts a cross-sectional view as in FIG. 2B where the barrier created by the stacked alternating dielectric and metallic strips is tilted relative to the waveguide axis.
Figure 4:
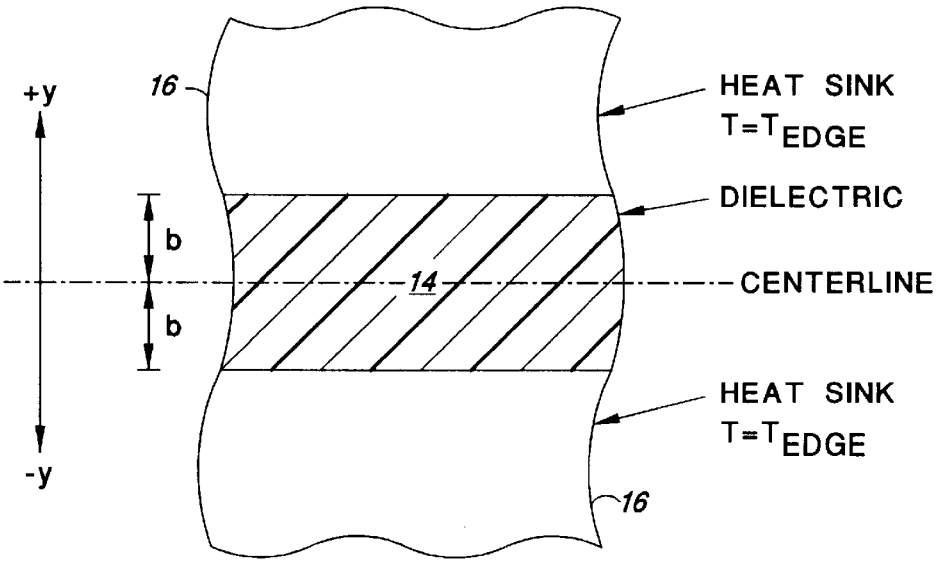
FIG. 4 (PRIOR ART)
FIG. 4 diagrammatically defines the dimensions used in a thermal analysis of the invention.
Figure 5:
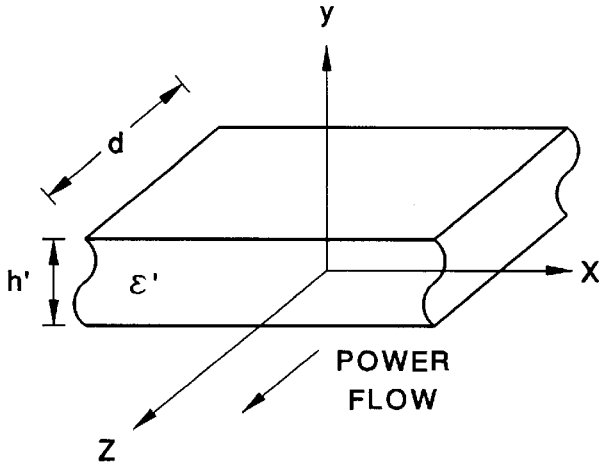
FIG. 5 (PRIOR ART)
FIG. 5 defines the coordinate system and linear dimensions associated with an ohmic loss analysis of the invention.
Figure 6:
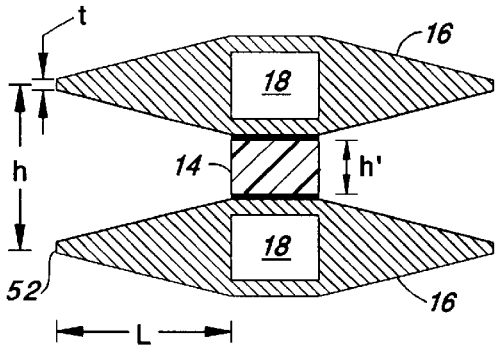
FIG. 6 (PRIOR ART)
FIG. 6 shows a typical cross-sectional view of a portion of a barrier as in FIG. 1 with blunt tapers.
Figure 7:
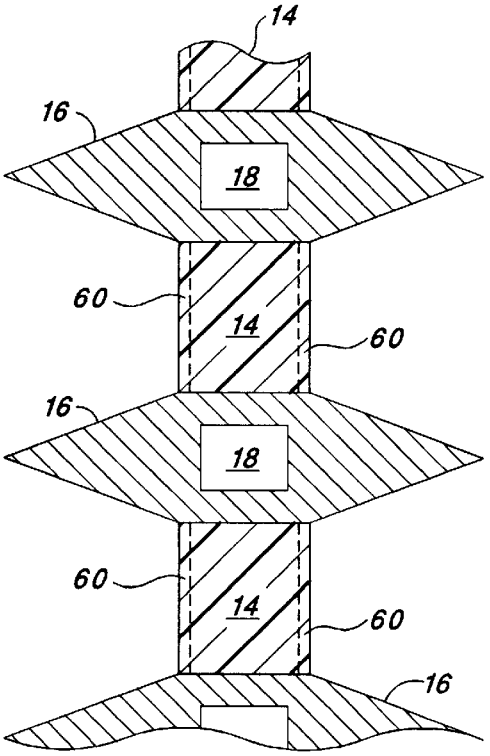
FIG. 7 (PRIOR ART)
FIG. 7 illustrates a cross-sectional view of a portion of a barrier used to form the microwave window as in FIG. 2A, and further shows the use of corrugations on opposing surfaces of the dielectric strips in order to lower the effective dielectric constant of the dielectric strips, and thereby minimize the dielectric and ohmic losses through the barrier.
Figure 8:
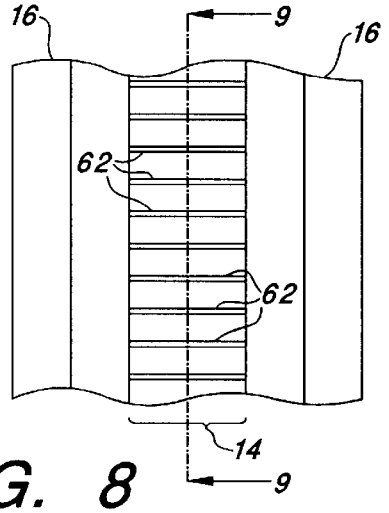
FIG. 8 (PRIOR ART)
FIG. 8 depicts a frontal view of a portion of the barrier of FIG. 7, and shows the preferred orientation of the corrugations relative to the dielectric and cooling strips.
Figure 9:
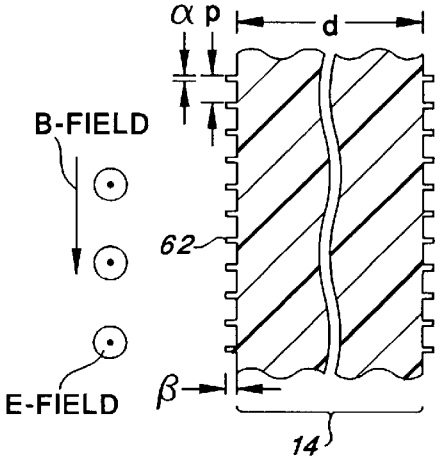
FIG. 9 (PRIOR ART)
FIG. 9 is a side sectional view taken along the line 9—9 of FIG. 8, and illustrates the parameters used to define the corrugations.

For comparison, reference should be made to FIG. 2A which shows a cross-sectional view of the conventional (original) distributed window section as taught in the '179 patent. The window includes a barrier 12 made up of vanes comprising alternating tapered metallic strips 16, having coolant channels 18 therein, and dielectric strips 14. Without the dielectric strips 14, the structure is very wide band.

Figure 10:
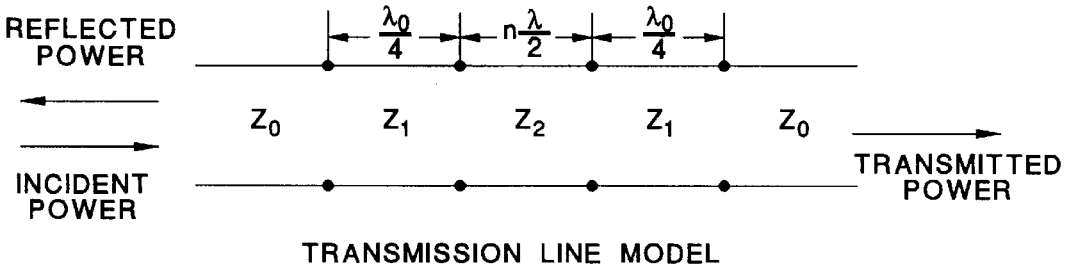
FIG. 10 shows a transmission line model useful in explaining and understanding the present invention.

Referring to the transmission line model of FIG. 10, it is well known if $Z_0$ is the system impedance, and if $Z_2$ is the impedance of another section of the transmission line, that at a given frequency $f_0$, if $\lambda_0=c/f_0$, where c is the velocity of light in the medium, then a matching section of impedance $$Z_1=\sqrt{Z_2Z_0}$$

and length $\lambda_0/4$, where $\lambda_0$ corresponds to the wavelength of the center frequency, $f_0$, of the desired band, will give the best match between lines of impedance $Z_0$ and $Z_2$. The transmission line model of the matched window would then appear as above, in the simplest case.

Figure 11:
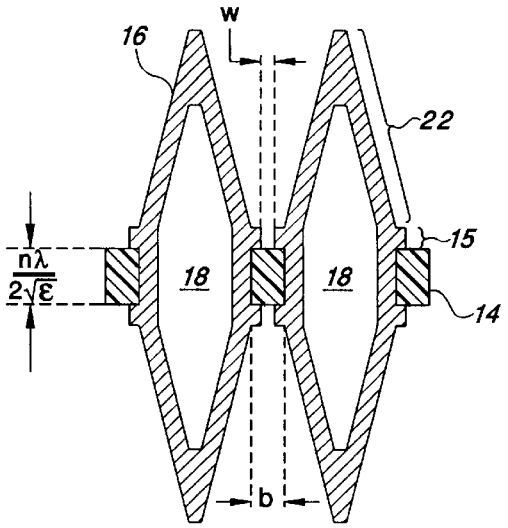
FIG. 11 illustrates a cross-sectional view of a portion of the barrier used with the window of the present invention, and illustrates one type of quarter wave impedance matching section that may be used with the invention.

Turning to FIG. 11, there is shown one embodiment of a vane structure that may be used to match impedances in accordance with the present invention. As seen in FIG. 11, the tapered metallic strips 16, are separated by a dielectric window 14, with a quarter wavelength, $\lambda/4$, matching section 15 on each side of the dielectric window 14. In general, the dielectric window is made of a strip of sapphire having a height b, and a width $n\lambda/(2\sqrt{\epsilon})$. The impedance Z of a waveguide section is proportional to $b/\sqrt{\epsilon}$, where $\epsilon$ is the dielectic constant of any dielectric filling the waveguide section. As an example, since $\epsilon=9.4$ for sapphire, and the height of the sapphire strip is, e.g., 0.022 inches (0.0559 cm), the vacuum matching section height w must be on the order of $$w=\sqrt{\frac{0.022\times 0.022}{\sqrt{9.4}}}=0.0126\text{ inches }(0.0319\text{ cm}).$$

This is a very small gap, and, as seen in FIG. 11, it covers part of the sapphire.

To work properly, the overlapping edge should be brazed to the sapphire. For the structure shown in FIG. 11, it may be difficult to be certain of this braze, and any overflow would be difficult to clean. Further, as seen best in the enlarged view of the sapphire/metal junction or joint in FIG. 12, it could be very difficult to inspect the joint for gaps.

Figure 12:
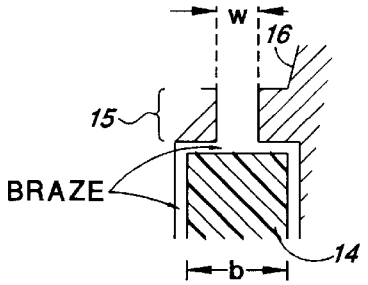
FIG. 12 shows an enlarged view of a portion of the barrier of FIG. 11.
Figure 13B:
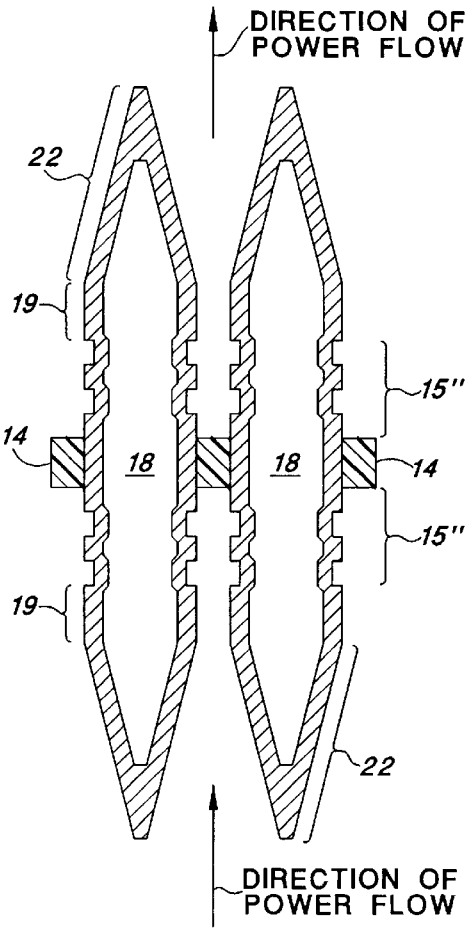
FIG. 13B depicts a cross-sectional view of a second alternative embodiment of the barrier used with the window, illustrating the use of an identical series of grooves (functioning as impedance matching sections) between the tapered vanes and the dielectric.
Figure 13A:
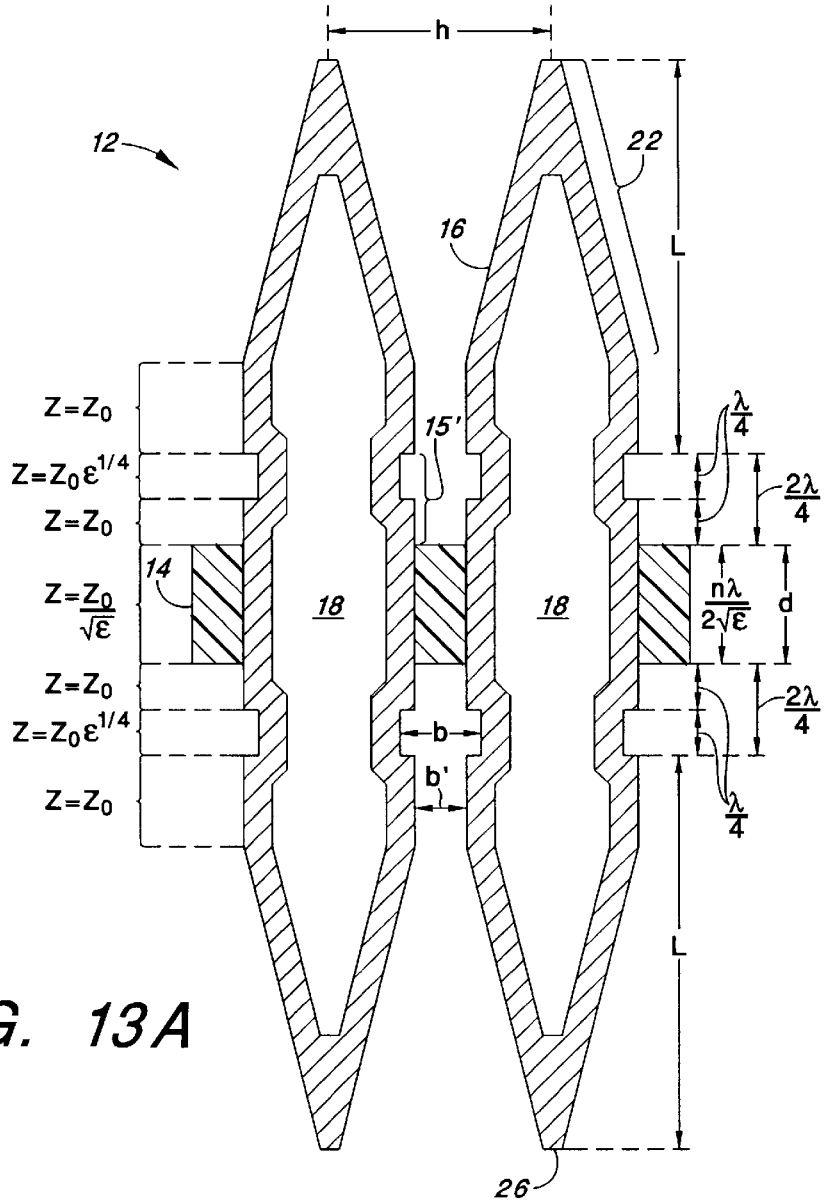
FIG. 13A depicts a cross-sectional view of a first alternative embodiment of the barrier used with the window of the present invention, illustrating the use of a series of quarter wave impedance matching sections between the tapered vanes and the dielectric.

Alternative embodiments to the structure shown in FIGS. 11 and 12 are shown in FIGS. 13A and 13B. Such embodiments, rather than using a low impedance matching section, follow the sapphire with a at least one $\lambda/4$ section of impedance $Z_0$ (vacuum section of same height as sapphire). Referring first to FIG. 13A (FIG. 13B is described more fully below), since the sapphire impedance is $Z_0/\sqrt{\epsilon}$, the impedance at the opposite end of a $\lambda/4$ matching section is $\sqrt{\epsilon}\cdot Z_0$ at the design frequency. To match this to $Z_0$ requires another $\lambda/4$ section of impedance $\epsilon^{1/4}\cdot Z_0$, which also requires a waveguide height (gap size) greater than the sapphire height, so there is a clear line of sight to the dielectric strip (having a width b') without covering or blocking any portion of the dielectric strip, i.e., so that there is a clear aperture of width b' to the sapphire.

As described above, it is thus seen that for the waveguide window embodiment shown in FIG. 13A, an impedance matching section 15' is used which is made up of two sections of size $\lambda/4$. Thus, as seen in FIG. 13A, the second and third set of opposing sides of the metallic strip 16 (which has generally a hexagonal-shaped cross section) combine to form a taper 22 on each side of the vacuum barrier 12 for each one of said metallic strips 16 that forms part of the microwave window barrier 12. Each of the tapers 22 has a tip or ridge 26 that extends the length of the metallic strip. The ridge is a distance L from the beginning of the impedance matching section 15'. The impedance matching section 15', in turn, has a length of $\lambda/4+\lambda/4$ or $\lambda/2$, where $\lambda$ is the free space wavelength of the electromagnetic radiation propagating through the waveguide. Thus, where the dielectric strip 14 has a thickness d, it is seen that the overall width of the barrier 12 of the embodiment shown in FIG. 13A, from tip-to-tip, is $2(L+\lambda/2)+d$.

Figure 14:
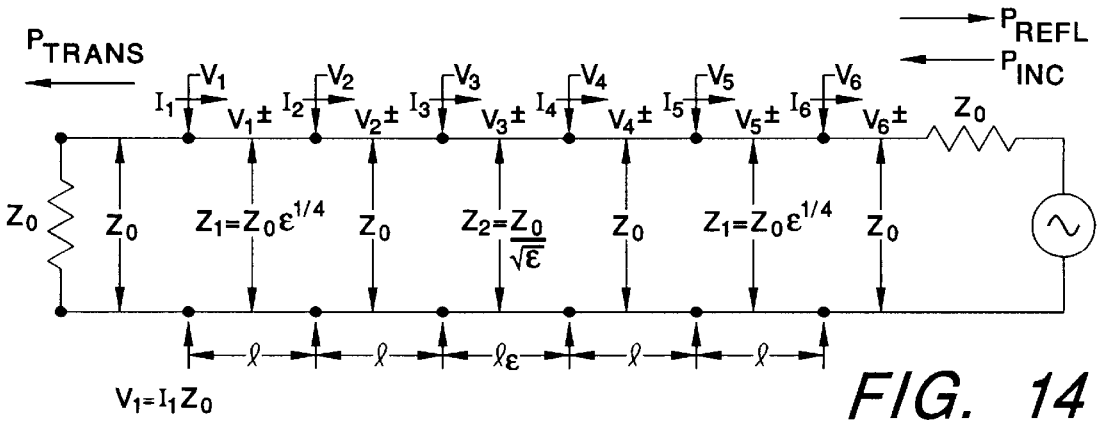
FIG. 14 shows an equivalent transmission line circuit useful in analyzing the performance of the microwave window of the invention.

To better understand the benefits of the arrangement shown in FIG. 13A, it is helpful to analyze the equivalent transmission line circuit shown in FIG. 14. From FIG. 14, the following relationships between the current and voltage at each node along the waveguide (transmission line) may be established:

$$\left.\begin{aligned} V_2 &= V_1^+e^{\gamma_1 l}+V_1^-e^{-\gamma_1 l} && \text{where } V_1=V_1^++V_1^- \\ I_2 &= \frac{V_1^+}{Z_1}e^{\gamma_1 l}-\frac{V_1^-}{Z_1}e^{-\gamma_1 l} && \text{where } Z_1I_1=V_1^+-V_1^- \end{aligned}\right\}\rightarrow\left\{\begin{aligned} V_1^+&=\frac{1}{2}(V_1+Z_1I_1)\\ V_1^-&=\frac{1}{2}(V_1-Z_1I_1)\end{aligned}\right\} \quad 1(a)$$

$$\left.\begin{aligned} V_3 &= V_2^+e^{\gamma_2 l}+V_2^-e^{-\gamma_2 l} && \text{where } V_2=V_2^++V_2^- \\ I_3 &= \frac{V_2^+}{Z_0}e^{\gamma_2 l}-\frac{V_2^-}{Z_0}e^{-\gamma_2 l} && \text{where } Z_0I_2=V_2^+-V_2^- \end{aligned}\right\}\rightarrow\left\{\begin{aligned} V_2^+&=\frac{1}{2}(V_2+Z_0I_2)\\ V_2^-&=\frac{1}{2}(V_2-Z_0I_2)\end{aligned}\right\} \quad 1(b)$$

-continued $$\left.\begin{aligned} V_4 &= V_3^+ e^{\gamma_3 l} + V_3^- e^{-\gamma_3 l} \quad \text{where} \quad V_3 = V_3^+ + V_3^- \\ I_4 &= \frac{V_3^+}{Z_2} e^{\gamma_3 l} - \frac{V_3^-}{Z_2} e^{-\gamma_3 l} \quad \text{where} \quad Z_2 I_3 = V_3^+ - V_3^- \end{aligned}\right\} \rightarrow \left.\begin{aligned} V_3^+ &= \frac{1}{2}(V_3 + Z_2 I_3) \\ V_3^- &= \frac{1}{2}(V_3 - Z_2 I_3) \end{aligned}\right\} \quad 1(c)$$

$$\left.\begin{aligned} V_5 &= V_4^+ e^{\gamma_2 l} + V_4^- e^{-\gamma_2 l} \quad \text{where} \quad V_4 = V_4^+ + V_4^- \\ I_5 &= \frac{V_4^+}{Z_0} e^{\gamma_2 l} - \frac{V_4^-}{Z_0} e^{-\gamma_2 l} \quad \text{where} \quad Z_0 I_4 = V_4^+ - V_4^- \end{aligned}\right\} \rightarrow \left.\begin{aligned} V_4^+ &= \frac{1}{2}(V_4 + Z_0 I_4) \\ V_4^- &= \frac{1}{2}(V_4 - Z_0 I_4) \end{aligned}\right\} \quad 1(d)$$

$$\left.\begin{aligned} V_6 &= V_5^+ e^{\gamma_1 l} + V_5^- e^{-\gamma_1 l} \quad \text{where} \quad V_5 = V_5^+ + V_5^- \\ I_6 &= \frac{V_5^+}{Z_1} e^{\gamma_1 l} - \frac{V_5^-}{Z_1} e^{-\gamma_1 l} \quad \text{where} \quad Z_1 I_5 = V_5^+ - V_5^- \end{aligned}\right\} \rightarrow \left.\begin{aligned} V_5^+ &= \frac{1}{2}(V_5 + Z_1 I_5) \\ V_5^- &= \frac{1}{2}(V_5 - Z_1 I_5) \end{aligned}\right\} \quad 1(e)$$

and where $$\left.\begin{aligned} V_6^+ &= \frac{1}{2}(V_6 + Z_0 I_6) \\ V_6^- &= \frac{1}{2}(V_6 - Z_0 I_6). \end{aligned}\right\} \quad 1(f)$$

Starting from the matched condition on the left side of FIG. 14, it is seen that $V_1=I_1Z_0$. One can find $V_2,I_2$ from Eq. (1a) above, $V_3,I_3$ from Eq. (1b) above, etc., to get $V^+_6$ and $V^-_6$ from Eq. (1f). The power from the generator is then $$\frac{|V_6^+|^2}{Z_0},$$

and the power to the load is $$\frac{|V_1|^2}{Z_0},$$

the power reflected back to the generator is $$\frac{|V_6^-|^2}{Z_0}.$$

Since $V_1$ is given and arbitrary, renormalization can be done so that the incident power, $P_{inc}$, from the generator is 1, the reflected power $P_{refl}$ from the load is $$\frac{|V_6^-|^2}{|V_6^+|^2}$$

and the power transmitted to the load $P_{trans}$ is $$\frac{|V_1|^2}{|V_6^+|^2}.$$

In this analysis, and with reference to FIG. 14, it is noted that $l=\lambda/4$, where $\lambda$ is the free space wavelength at the design center frequency, $$l_E = \frac{n\lambda}{2\sqrt{\in}},$$

where n is an integer, $$\frac{\lambda}{2\sqrt{\in}} \approx \frac{1}{2}$$

wavelength in the dielectric of dielectric constant $\epsilon$, and the $\lambda$'s represent complex propagation constants. That is, $\gamma_1=\alpha_1+i\beta_1$, where $$\alpha_1 = \frac{R_{VAC}}{b_0 \cdot \in^{1/4}} \text{ and } \beta_1 = k_0.$$

Similarly, $\gamma_2=\alpha_2+i\beta_2$, where $\alpha_2=R_{VAC}/b_O$ and $\beta_2=k_0$; and $\gamma_3=\alpha_3+i\beta_3$, where $$\alpha_3 = \frac{R_E \cdot \sqrt{\in}}{b_0} \text{ and } \beta_3 = \frac{k_0}{\sqrt{\in}}.$$

Here, $k_0=2\pi f/c$, where f is the applied frequency and c is the freespace velocity of light, $b_0$ is the height of the dielectric, $R_{VAC}$ is the surface resistance of the frame material normalized to 377 ohms, and $R_E$ is the surface resistance of the sapphire braze material seen at the edge of the sapphire, normalized to 377 ohms.

By way of example, if $b_0$=0.022 inches, $\epsilon$=9.4 for sapphire, $R_{VAC}$=0.26 ohms at 170 GHz, and $R_E$=0.52 ohms at 170 GHz. Note that $R_E$ is multiplied by $\sqrt{\epsilon}$ in the term $\alpha_3$ since the impedance is $$\frac{Z_0}{\sqrt{\in}}.$$

The additional dielectric loss is not specifically included, but can be considered to be lumped into $R_E$. In this example n=3, (3-$\lambda/2$ in the dielectric).

Figure 15:
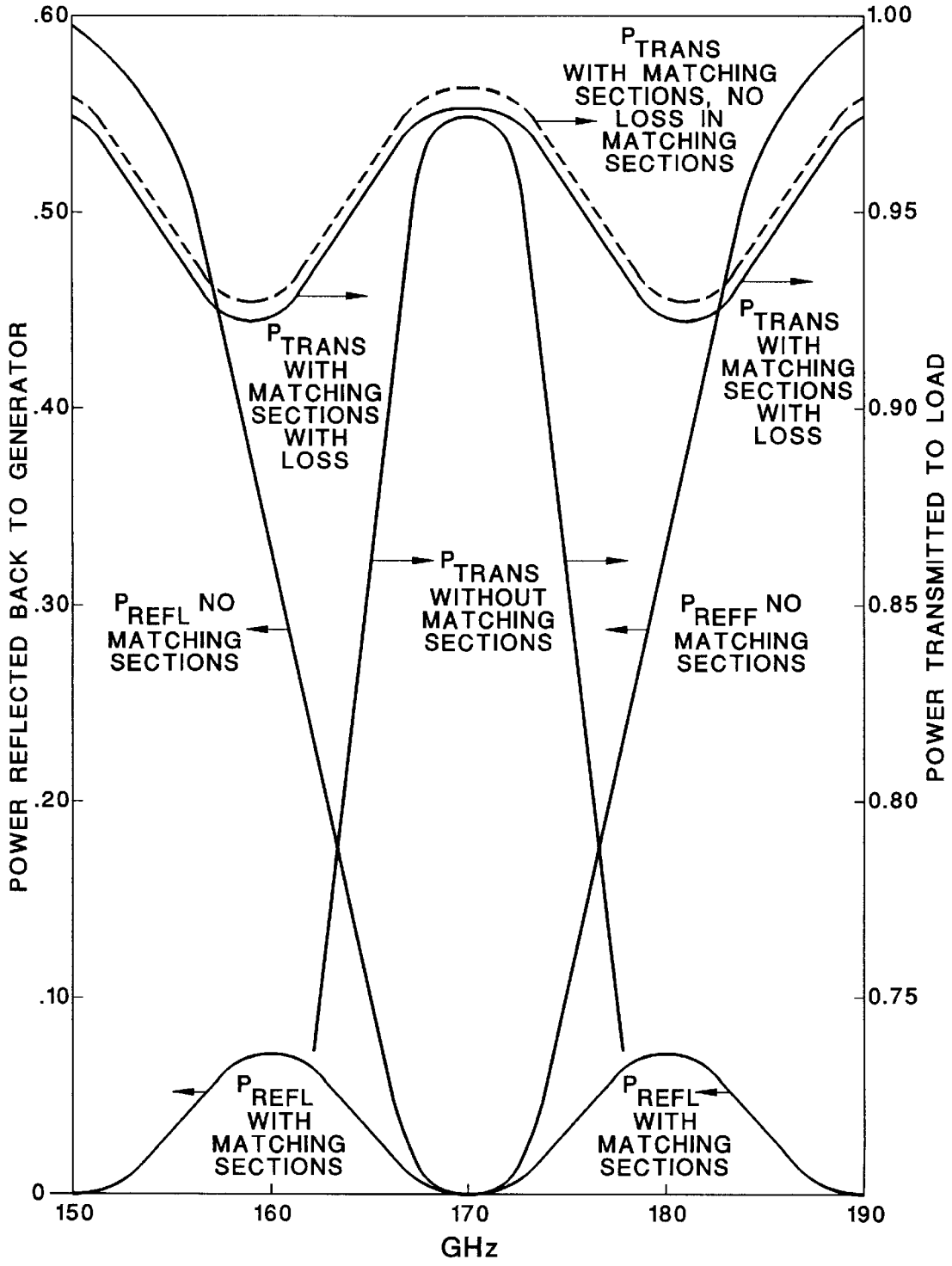
FIG. 15 is a graph illustrating power transmitted to and reflected from the load through the window as a function of frequency.

FIG. 15 is a graph that shows the dramatic reduction in reflection away from the design center frequency when the matching sections are used, as described above, compared to a window without matching sections. With matching sections, the reflection never exceeds 6%, and that occurs 10 GHz away from the center frequency of 170 GHz. Without the matching sections, a 6% reflection occurs 3.5 GHz away from 170 GHz, and the reflection keeps increasing to a maximum of about 60%. Such strong reflections could affect the gyrotron operation if the window center frequency deviates from the gyrotron operating frequency. For a 2% reflection, with matching sections, the bandwidth is over 8 GHz (over 4 GHz on either side of the center frequency 170 GHz). In contrast, with the unmatched window of the same thickness, the 2% bandwidth is <4 GHz. Note that this occurs with a sapphire window only 1 h wavelengths (in the sapphire) thick, or 0.034 inches at 170 GHz. A thicker window without matching sections would be proportionally narrower in bandwidth.

As also seen in the graph of FIG. 15, less dramatic, but of at least equal importance, is the reduction in loss at the center frequency when the window is matched. This results in only a traveling wave passing through the dielectric, compared to the prior art distributed (or single or double disk) resonant window, where reflection is avoided by making the window an integral number of ½ wavelengths (in the dielectric) thick, thereby resulting in a standing wave in the dielectric, which increases both dielectric loss and ohmic dissipation at the walls of the waveguide. The ratio of dissipation for the unmatched resonant window compared to that of the matched window with a traveling wave is $(\epsilon'+1)/(2\sqrt{\epsilon'})$, or about 1.70 for $\epsilon'=9.4$ (note, $\epsilon'$ is the real part of $\epsilon$), appropriate for sapphire. If the losses in the matching section are included, as is true for the solid curves in FIG. 15, the reduction in total loss will be less than the case in which the matching sections are lossless.

However, it is pointed out that the total loss is not the most important consideration. The maximum continuous wave (CW) power that the window can handle is limited by the Watts/cm$^2$ at the sides of the sapphire where they are brazed to the metal frame, the back sides of which are water cooled. If the combined loss from dielectric heating and ohmic loss at the sapphire-braze interface can be reduced by 1/1.7, the window will be able to pass 1.7 times as much power compared to the unmatched, resonant window, even though the dissipation in other parts of the frame is increased. This is because the matching sections have a larger area that is water cooled than the sapphire, and the loss in the matching sections is still not nearly as large as the total loss in the (matched) sapphire window. As a result, it is still the Watts/cm$^2$ at the window-frame interface that limits the power handling at the window.

Figure 16:
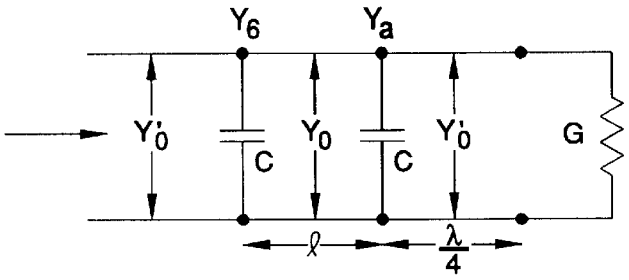
FIG. 16 depicts the equivalent circuit of the window on either side of the dielectric.

The model circuit shown in FIG. 14 does not include the effect of the step discontinuity, which, as presented in the Waveguide Handbook by N. Marcuvitz (published by Dover books, NY, N.Y.), pages 307–309, has the effect of introducing an equivalent shunt capacitance at the step. The equivalent circuit on either side of the dielectric is then as shown in FIG. 16. The circuit shown in FIG. 16 is written in terms of admittances rather than impedances to simplify treating the shunt elements. Thus, in FIG. 16, G is the (real) admittance seen at the interface with the dielectric, assuming a traveling wave ($G/Y_0'=\sqrt{\epsilon}$), $Y_0$ and $Y_0$ are the characteristic admittances of the parallel plate waveguide sections of heights b' and b, respectively, to use the notation of Marcuvitz, and the C's are the capacitances due to the discontinuity, each having an admittance iB, which is purely imaginary. Because of these capacitances, the optimum spacing between steps is no longer $\lambda/4$, but will be denoted by l. Since the dielectric-vacuum interface does not introduce such a capacitance, because there are no higher modes excited at such an interface, no correction is needed in the distance from the dielectric to the first step.

The conductance G, transformed by the right hand $\lambda/4$ section, contributes conductance $$S_1 \equiv \frac{(Y_0')^2}{G}$$

to $Y_\alpha$, so the total admittance $Y_{\alpha\ is\ Y\alpha}=S_1+iB$. The ratio of the admittance $Y_b/Y_0$ may be expressed as $$\frac{Y_b}{Y_0} = \frac{Y_a + iY_0\tan\beta l}{(Y_0 + iY_a\tan\beta l)} + \frac{iB}{Y_0}.$$

The objective is to transform $S_1$ to another real admittance $S_2$ at $Y_6$. For a single section transformer, $S_2$ would be $Y_0'$, while if there is a following section to the left, $S_2$ would be an intermediate value between $S_1$ and $Y_0'$. In any event, $Y_6=S_2$ is to be real. In addition, since for B=0, $\beta l_0=\pi/2$, let $\beta l=\pi/2+\delta$ for B>0. Then $\tan\beta l=-1/\tan\delta\equiv-1/\Delta$. Then defining $S_1\equiv S_1/Y_0'$, $B\equiv B/Y_0'$ and $\alpha\equiv Y_0/Y_0'=b'/b$, where b' and b are the respective heights of the $Y_0'$ and $Y_0$ admittance waveguides, it is seen that $$\bar{S}_2 - i\bar{B} = \frac{(\bar{S}_1 + i\bar{B})\Delta - ia}{[\Delta - i(\bar{S}_1 + i\bar{B})]/\alpha}. \tag{2}$$

The real and imaginary parts of Eq. (2) give $\Delta=-\bar{B}/\alpha$ and $$2\bar{B}\Delta + \bar{S}_1\left(\frac{\bar{S}_2}{\alpha}\right) + \frac{(\bar{B})^2}{\alpha} - \alpha = 0,$$

respectively. Since $\bar{B}$ is $\geqq 0$, and $\alpha$ is positive, $\Delta\leqq 0$ which means $l\leqq\lambda/4$. Eliminating $\alpha$ from the two equations, it is seen that $$\Delta^2 = \frac{(\bar{B})^2}{(\bar{S}_1\bar{S}_2 - \bar{B}^2)} \tag{3}$$

or $$\Delta = -\frac{\bar{B}}{\sqrt{\bar{S}_1\bar{S}_2 - \bar{B}^2}} \tag{4}$$

Thus, it is seen than $$\alpha = \sqrt{(\bar{S}_1\bar{S}_2 - \bar{B}^2)}.$$

Since $\bar{\beta}$ B depends on $\alpha$ in the analysis in Marcuvitz, it is necessary to proceed iteratively, starting with $\bar{B}=0$, giving $$\alpha = \sqrt{S_1S_2},$$

and using the value of $\bar{B}$ so obtained to give $\Delta$. This approach is practical for small $\bar{B}$ (e.g., $\bar{B}^2 \ll S_1S_2$), since $\alpha$ then depends only weakly on $\bar{B}$, while $\Delta$ has a first order dependence on $\bar{B}$.

For the preceding example, with $\epsilon=9.4$, and b'=0.022", it is seen that $b=0.022\cdot\epsilon^{1/4}=0.0385$ inches; and according to Marcuvitz, $$\left(\frac{B}{Y_0}\right)\left(\frac{\lambda_g}{b}\right) = 0.70$$

$$= \left(\frac{B}{Y_0'}\right)\left(\frac{Y_0'}{Y_0}\right)\left(\frac{\lambda_g}{b}\right) = \left(\frac{B}{Y_0'}\right)\left(\frac{\lambda_g}{b'}\right).$$

Since the other transverse dimension is much larger than a free space wavelength, $\lambda_g \approx \lambda_0 = c/f$, it is seen that $\tan\delta = -0.433$, and the ratio of the corrected transformer section length l to the uncorrected length $l_0 = \lambda/4$ is $l/l_0 = 0.74$.

To determine the reflection and transmission properties of the window with the corrected transformer section length, an analysis similar to that presented above in connection with FIG. 14 is performed. In particular, reference is made to FIG. 17, where it is seen that $l_1 = l_5 = l$, the corrected length, $l_2 = l_4 = \lambda/4$, and $l_3 = n\lambda/(2\sqrt{\epsilon})$. If α is set equal to $\alpha \equiv Y_0/Y_0' = b'/b$, then, from right to left in FIG. 17, with a termination $G = Y_0'$ on the right, it is seen that $$I_0 = V_1 G = V_1 Y_0' \tag{5a}$$

$$I_1 = I_0 + iV_1 B = V_1 Y_0'\left(1 + \frac{iB}{Y_0'}\right) \tag{5b}$$

$$V_2 = V_1^+ e^{+\gamma l_1} + V_1^- e^{-\gamma l_1} \tag{5c}$$

$$\text{where } V_1^+ + V_1^- = V_1 \text{ and } Y_0(V_1^+ - V_1^-) = I_1 \tag{5d}$$

$$\text{so that } V_1^\pm = \frac{1}{2}\left(V_1 \pm \frac{I_1}{Y_0}\right) \tag{5e}$$

$$\text{and } I_2 - iV_2 B = Y_0(V_1^+ e^{+\gamma l_1} - V_1^- e^{-\gamma l_1}). \tag{5f}$$

In the above equations, $V^+e^{+\gamma Z}$ represents a wave traveling to the right with propagation constant $\gamma = \alpha + i\beta$, with α comprising the attenuation constant, and $\beta = \omega/c$ comprising the phase shift/unit length in the z direction, except in the dielectric, where $$\beta = \sqrt{\epsilon}\left(\frac{\omega}{c}\right).$$

Likewise, $V^-e^{-\gamma Z}$ represents a wave traveling to the left. B is the (positive) capacitive susceptance of the discontinuity capacitance which, because of symmetry, is the same at all the steps.

Figure 17:
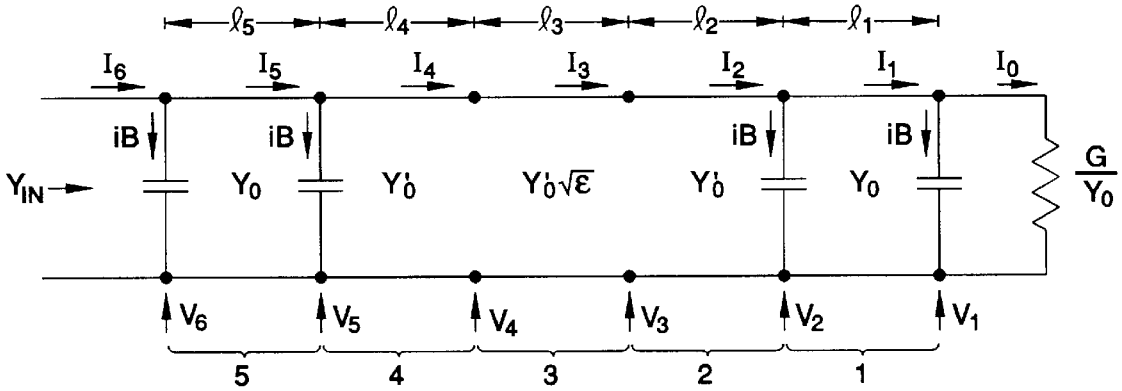
FIG. 17 shows an equivalent circuit of the window configured in terms of voltages and characteristic admittances.

Continuing with the analysis of FIG. 17, it can be shown that:

$$V_3 = +V_2^+ e^{\gamma 2 l_2} + V_2^- e^{-\gamma 2 l_2} \tag{6a}$$

$$V_2^+ + V_2^- = V_2 \tag{6b}$$

$$Y_0'(V_2^+ - V_2^-) = I_2 \tag{6c}$$

$$\text{so that } V_2^\pm = \frac{1}{2}\left(V_2 \pm \frac{I_2}{Y_0'}\right) \tag{6d}$$

$$\text{and } I_3 = Y_0'(V_2^+ e^{\gamma 2 l_2} - V_2^- e^{-\gamma 2 l_2}). \tag{6e}$$

$$V_4 = V_3^+ e^{\gamma 3 l_3} + V_3^- e^{-\gamma 3 l_3} \tag{7a}$$

$$V_3^+ + V_3^- = V_3 \tag{7b}$$

$$Y_0'\sqrt{\epsilon}\,(V_3^+ - V_3^-) = I_3 \tag{7c}$$

$$\text{so that } V_3^\pm = \frac{1}{2}\left(V_3 \pm \frac{I_3}{\sqrt{\epsilon}\,Y_0'}\right) \tag{7d}$$

-continued $$\text{and } I_4 = \sqrt{\epsilon}\,Y_0'(V_3^+ e^{\gamma 3 l_3} - V_3^- e^{-\gamma 3 l_3}). \tag{7e}$$

$$V_5 = V_4^+ e^{\gamma 4 l_4} + V_4^- e^{-\gamma 4 l_4} \tag{8a}$$

$$V_4^+ + V_4^- = V_4 \tag{8b}$$

$$Y_0'(V_4^+ - V_4^-) = I_4 \tag{8c}$$

$$\text{so that } V_4^\pm = \frac{1}{2}\left(V_4 \pm \frac{I_4}{Y_0'}\right) \tag{8d}$$

$$\text{and } I_5 - iBV_5 = Y_0'(V_4^+ e^{\gamma 4 l_4} - V_4^- e^{-\gamma 4 l_4}). \tag{8e}$$

$$V_6 = V_5^+ e^{\gamma 5 l_5} + V_5^- e^{-\gamma 5 l_5} \tag{9a}$$

$$V_5^+ + V_5^- = V_5 \tag{9b}$$

$$Y_0'(V_5^+ - V_5^-) = I_5 \tag{9c}$$

$$\text{so that } V_5^\pm = \frac{1}{2}\left(V_5 \pm \frac{I_5}{Y_0}\right) \tag{9d}$$

$$\text{and } I_6 - iBV_6 = Y_0(V_5^+ e^{\gamma 5 l_5} - V_5^- e^{-\gamma 5 l_5}). \tag{9e}$$

Finally, $$V_6^\pm = \frac{1}{2}\left(V_6 \pm \frac{I_6}{Y_0'}\right),$$

where $Y_0'$ is assumed to be the characteristic admittance of the input (and output) waveguides. The ratio of reflected forward power at the input to the circuit shown in FIG. 17 is just $|V^-_6/V^+_6|^2$, the ratio of reverse to forward power flowing through the dielectric is just $|V^-_3/V^+_6|^2$, while the ratio of generator forward power incident on the circuit from the left to the power in the load is just $|V_1/V^+_6|^2$. These expressions may be evaluated numerically in sequence, starting with an arbitrary value of $V_1$ and $Y_0'$, since only the ratio of voltages and admittances are important in the final result.

Using the same numerical example presented previously, and assuming the value of $B/Y_0' = 0.227$ and $l_1(=l_5)/(\lambda/4) = l/l_0 = 0.74$ as used previously, it is seen that the reflection, transmission, and reflection coefficient in the dielectric are as shown in the graph of FIG. 18. Correcting for the discontinuity capacitance actually widens the bandwidth, or at least reduces the peak reflections compared to the uncorrected example previously presented (see FIG. 15), which uses a different vertical scale. The curves shown in FIG. 18 assume the same α's as used in FIG. 15, $R_{VAC} = 0.26$ ohms, $R_{dielectric} = R_E = 0.52$ ohms.

Although the result presented in FIG. 18 is very attractive, it is possible that a further correction may be required in the length of the matching section to account for any interaction that occurs between the steps due to evanescent higher mode fields excited by such large steps so close together, and further due to the waveguide height b of the transformer section being larger than λ/2. (Note, for the examples given at 110 GHz, λ/2=0.34 inches, while b=0.0385 inches.) The next higher mode in fact can propagate, but is antisymmetric, and so in principle is not excited if the steps in the facing vanes are identical, although at these wavelengths, achieving truly identical steps may be difficult if not impossible to achieve. Also, it is noted that the graph shown in FIG. 18 does not include the iterative process discussed above, which should make the reflected power zero at 170 GHz in the sapphire, but which would make the dimension b even larger. The less than 1% reflected power in the dielectric is really very acceptable, however, so such an iteration is unnecessary. Nevertheless, the issue of the effect of an evanescent mode is a concern. (A more detailed analysis might provide guidance on whether some small change in the transformer length could compensate for such effects, but it would also be useful to have an alternative design that does not require such a large step.) Another advantage to a smaller step in the transformer section is that a large step constricts the coolant channel, making the manufacture thereof more difficult.

Figure 19:
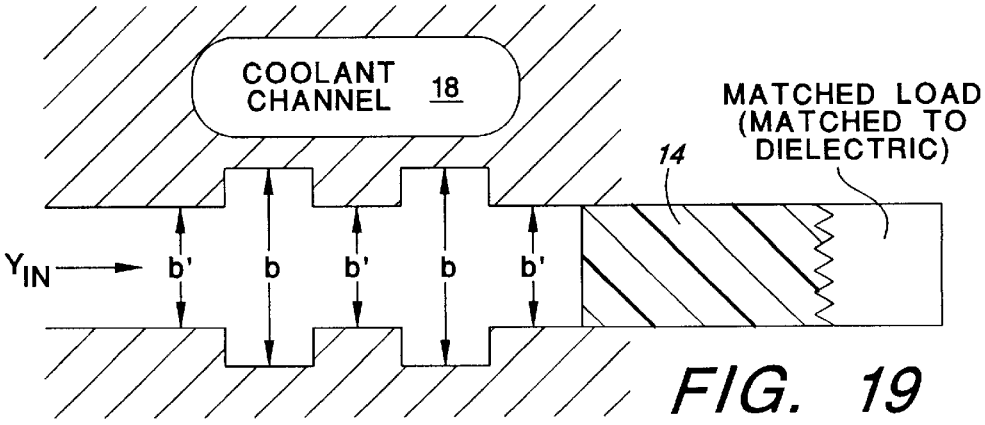
FIG. 19 shows additional detail associated with the second alternative embodiment of FIG. 13B.

With the foregoing comments in mind, the proposed solution is to have two smaller ratio transformers in series, each of which uses a smaller step, as shown in FIG. 19. The equivalent circuit (for analysis purposes) of the structure shown in FIG. 19 is shown in FIG. 20.

For the equivalent circuit shown in FIG. 20, $Y_0'$, $Y_0$ are the characteristic admittances of the transmission line sections, and $Y_1, Y_2, \ldots Y_5$ are the admittances (i.e., the ratio of the current to the voltage in this transmission line equivalent circuit) at the indicated terminals. Starting at the right side of FIG. 20, it is seen that $Y_1=G\equiv Y_0'\sqrt{\epsilon}$; $Y_2=(Y_0')^2/Y_1$; $Y_3=(Y_0)^2/Y_2$; $Y_4=(Y_0')^2/Y_3$; and $Y_5=Y_0)^2/Y_4$. Thus, $$Y_5=\left[\frac{Y_0}{Y_0'}\right]^4 Y_0'\sqrt{\in}\,. \tag{10}$$

The expression set forth in Eq. (10) is only true, it should be noted, at the design (or center) frequency for which the sections of waveguide (or equivalent transmission line) are exactly $\lambda/4$ long, A being the wavelength at the design frequency. If it is desired to have $Y_5$ be equal to $Y_0'$, so there is no reflection at the circuit input (on the left of FIG. 20), then $$\left(\frac{Y_0'}{Y_0}\right)=\in^{(1/8)} \tag{11}$$

and $$\left(\frac{b}{b'}\right)=\in^{(1/8)} \tag{12}$$

As in the previously provided examples, if b'=0.022 inches, $\epsilon$=9.4, then b=1.323b'=0.0291 inches. This value of b may be compared with $b=b'\epsilon^{1/4}=1.75b'=0.0385$ inches, which is a single section transformer (as shown, e.g., in FIG. 13A).

The correction to the transformer lengths to compensate for the discontinuity capacitance is now, using Marcuvitz, $B/Y_0'=0.0809$, which gives, from the expressions given above, $\tan\delta=-(B/Y_0')/\sqrt{\epsilon}\epsilon^{1/4}/^{1/2}-(B/Y_0)^2=-0.107$, compared to −0.433 for the single section transformer described above in connection with FIG. 13A. Then $l/l_0=(\pi/2+\delta)/(\pi/2)=0.932$. This represents only a −7% change in the lengths required for each of the impedance sections (whether they be high impedance or low impedance) of the transformer.

Referring next to FIG. 13B, there is shown a partial cross-sectional view of the distributed window with 2-section transformers 15" to match the dielectric strips to parallel waveguide without dielectric, which is in turn matched to free space by the taper sections.

A detailed analysis of the dual transformer structure 15" of FIG. 13B (and FIGS. 19 and 20), including the frequency dependence, is similar to that which has been presented above relative to the single section transformer 15' of FIG. 13A, but with the addition of a further transformer section on each side of the dielectric. When such an analysis is carried out, the results shown in the graph of FIG. 21 are achieved.

Figure 21:
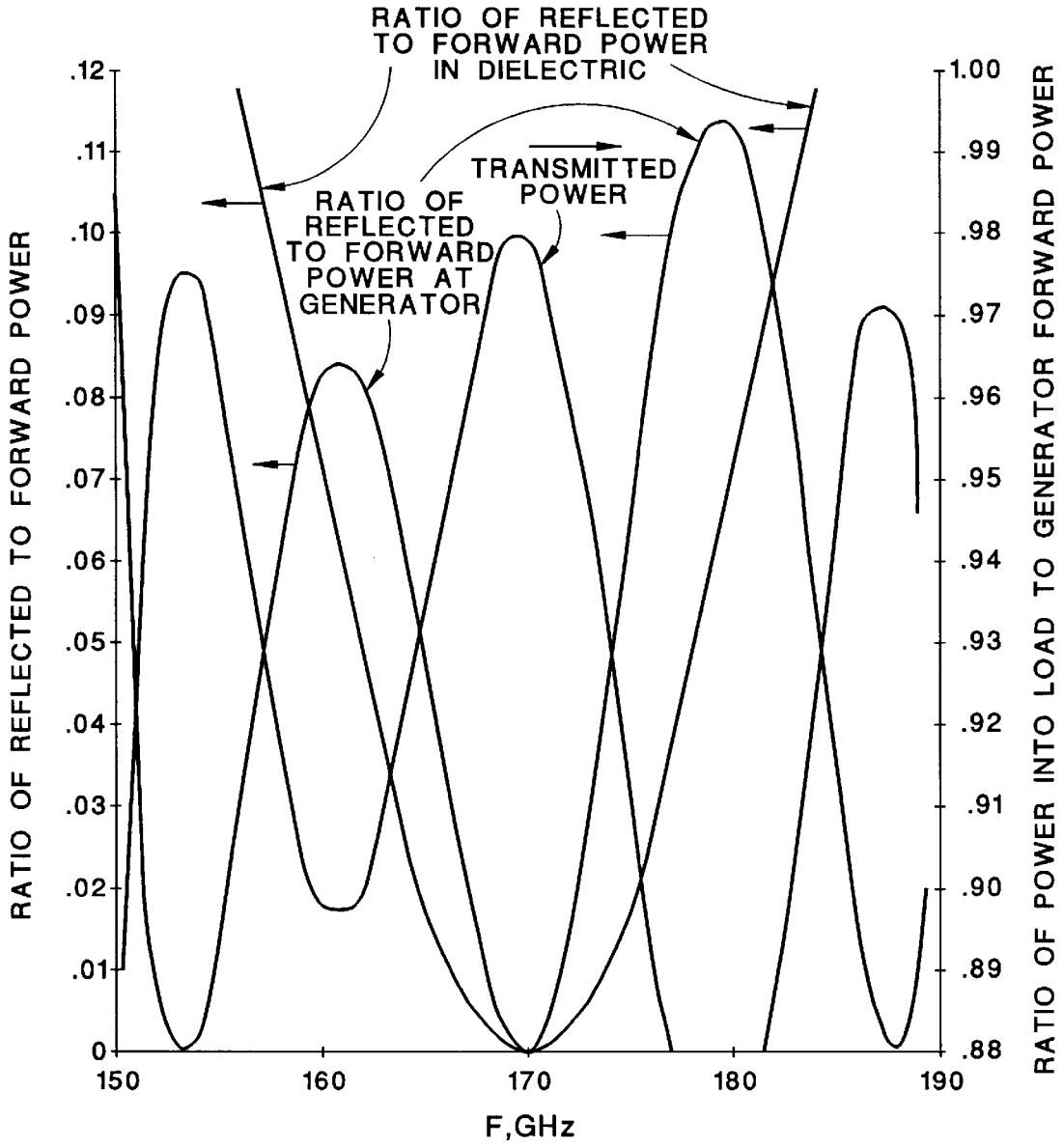
FIG. 21 is a graph that illustrates the ratio of reflected to forward power, and the ratio of power delivered to the load and power generated as a function of frequency for the waveguide window structure of FIG. 13B.

In FIG. 21, for the vertical scale that is used, the reflections of power may look rather high. However, they are still much reduced, the useful bandwidth is increased, compared with the example when no matching section is used (FIG. 15). More important, the reflection in the dielectric achieved using the dual-transformer section depicted in FIGS. 13B, 19, 20 and 21, is less than one percent over more than 6 GHz. This means that the dissipation in the dielectric will be reduced to less than 60% of the value without the matching transformers.

Another potentially useful aspect of the geometry illustrated in FIGS. 13B and 19, which may improve the transmitted efficiency, is the possible adjustment available by varying the length of the phase shift region 19 (FIG. 13B). The phase shift region (or phase shift section) length can be adjusted as required to adjust the phase relation between the residual reflections due to the taper regions 22 (or taper sections) and the reflections of the region between the tapers (the dielectric and transformer sections/regions). In particular, the taper reflections may be put in quadrature with the other reflections, so they do not add constructively, by making the phase shift regions 19 $\lambda/4$ long at the center frequency. Alternatively, such regions 19 could be used to subtract from the residual reflections, although these reflections are very small at the center frequency (which center frequency is 170 GHz in the previous examples). The phase shift sections/regions 19 could also be used, if the reflections of the dielectric and transformer are negligible, to ensure that the reflections from the taper at one end cancel those from the other end.

As described above, it is thus seen that the present invention provides a way to widen the bandwidth of a large diameter distributed microwave window by using one or more transformer sections as part of the vane structure of such window.

While the invention has been described with reference to one or two particular embodiments thereof, the invention is not intended to be so limited. Numerous variations of the invention could be realized by those of skill in the art given the main concepts presented and disclosed herein.

What is claimed is:

1. A wide bandwidth distributed microwave window for use within a microwave waveguide (32) comprising:

a plurality of alternating dielectric strips (14) and metallic strips (16) stacked and sealed to form a vacuum barrier (12);

said vacuum barrier being positioned and sealed so as to provide a physical barrier within the interior of said waveguide (32); and wherein each of said plurality of dielectric strips (14) has a substantially rectangular cross-sectional shape; with a first set of opposing sides being sealed to respective sides of adjacent ones of said metallic strips (16), and with a second set of opposing sides fronting the interior of said waveguide, each of said metallic strips (16) has a substantially hexagonal cross-sectional shape, with a first set of opposing sides being sealed to respective sides of adjacent ones of said dielectric strips (14), and with a second and third set of opposing sides of said hexagonal-shaped metallic strip being exposed to the interior of said waveguide to form a taper (22), and each of said metallic strips (16) further includes an impedance matching section (15) positioned between the taper (22) and the dielectric strip (14) which comprises at least one quarter wave matching section positioned within the window to render the dielectric strip (14) non-resonant.

2. The wide bandwidth microwave window as set forth in claim 1 wherein said impedance matching section (15') comprises at least two quarter wave matching sections.

3. The wide bandwidth microwave window as set forth in claim 2 wherein the impedance matching section (15') provides a clear line of sight to the dielectric strip (14) without covering or blocking any portion of the dielectric strip.

4. The microwave window as set forth in claim 1, wherein said metallic strips and dielectric strips of said vacuum barrier are oriented within said waveguide to be perpendicular to a transverse electric field component of an incident wave of electromagnetic microwave radiation that is propagating through said waveguide.

5. The microwave window as set forth in claim 1 wherein a plurality of said metallic strips (16) each include at least one coolant channel (18) that passes longitudinally therethrough.

6. The microwave window as set forth in claim 5 wherein the second and third set of opposing sides of said hexagonal-shaped metallic strip combine to form a taper (22) on each side of the vacuum barrier for each one of said metallic strips (16), each of said tapers having a ridge (26) that extends the length of said metallic strip; said ridge being a distance L from the impedance matching section (15); said impedance matching section having a length of $n\lambda/4$, where n is an integer equal to the number of $\lambda/4$ sections included in the the impedance matching section; and said dielectric strip having a thickness d; whereby the overall thickness of the vacuum barrier (12) from ridge-to-ridge is $2(L+n\lambda/4)+d$, where $\lambda$ is the free space wavelength of the electromagnetic radiation propagating through said waveguide.

7. The microwave window as set forth in claim 6 wherein each dielectric strip is made from sapphire.

8. Coupling apparatus for coupling microwave power between the $HE_{11}$ mode in a first waveguide to the $HE_{11}$ mode in a second waveguide, said apparatus comprising:

a vacuum barrier (12) separating said first and second waveguide, said vacuum barrier including a plurality of parallel dielectric strips (14), each dielectric strip being separated from an adjacent dielectric strip by a metallic cooling strip (16), the distance between a center line of adjacent dielectric strips being approximately a distance h, where $h<\lambda_0$, where $\lambda_0$ is the free space wavelength associated with the microwave power being coupled between said first and second waveguide, and further wherein the metallic cooling strip includes an impedance matching section (15') which comprises at least one quarter wave matching section of length $\lambda_0/4$ positioned within the vacuum barrier to render the dielectric strip (14) non resonant, the thickness of the vacuum barrier thus being a distance d through said dielectric strips, and a distance $d+2(L+n\lambda_0/4)$ through the thickest part of said metallic cooling strips, where L is the distance between a ridge of the metallic cooling strip (16) and the impedance matching section (15'), and n is an integer equal to the number of quarter wave matching sections, whereby each metallic cooling strip extends perpendicularly out from a plane surface of said dielectric strips a distance $L+n\lambda_0/4$;

the dielectric strips of said vacuum barrier being oriented so as to be longitudinally perpendicular to an electric field component of said microwave power.

9. A method of forming a vacuum barrier that separates first and second waveguides, said method comprising the steps of:

(a) forming a plurality of dielectric strips so that the thickness of said vacuum barrier is a distance d through said dielectric strips;

(b) forming a plurality of metallic cooling strips so that there is a distance $d+2(L+n\lambda_0/4)$ through the thickest part of said metallic cooling strips, each metallic cooling strip extending perpendicularly out from a plane surface of said dielectric strips a distance $L+n\lambda_0/4$, where n is an integer, L is the distance between a ridge of the metallic cooling strip and a quarter wave matching section, and $\lambda_0$ is the free space wavelength associated with microwave power being transmitted through the waveguides, and wherein the metallic cooling strips include at least one quarter wave matching section positioned within the window to render the dielectric strip non-resonant;

(c) adjoining a cooling strip on each side of each dielectric strip, thereby forming a barrier, such that the distance between a center line of adjacent dielectric strips is a distance h, where $h<\lambda_0$; and (d) mounting said barrier between said first and second waveguides so as to separate said first and second waveguides, and orienting the dielectric strips to be perpendicular to an electric field component of microwave power propagating through said first and second waveguides.

10. The method of claim 9 wherein step (b) includes forming the metallic cooling strips to include at least two quarter wave matching sections positioned within the window.

* * * * *